US009744644B2

(12) United States Patent
Spires

(10) Patent No.: US 9,744,644 B2
(45) Date of Patent: Aug. 29, 2017

(54) CLADDING HAVING AN ARCHITECTURAL SURFACE APPEARANCE

(71) Applicant: Brian Spires, Kingston, MA (US)

(72) Inventor: Brian Spires, Kingston, MA (US)

( * ) Notice: Subject to any disclaimer, the term of this patent is extended or adjusted under 35 U.S.C. 154(b) by 0 days.

(21) Appl. No.: 14/515,954

(22) Filed: Oct. 16, 2014

(65) Prior Publication Data

US 2015/0104578 A1 Apr. 16, 2015

Related U.S. Application Data

(62) Division of application No. 12/709,332, filed on Feb. 19, 2010, now abandoned.

(60) Provisional application No. 61/154,270, filed on Feb. 20, 2009.

(51) Int. Cl.

| | |
|---|---|
| ***B05D 3/12*** | (2006.01) |
| ***B05D 5/02*** | (2006.01) |
| ***B24C 1/06*** | (2006.01) |
| ***B05D 3/00*** | (2006.01) |
| ***B24C 1/04*** | (2006.01) |
| ***B24C 11/00*** | (2006.01) |

(52) U.S. Cl.

CPC ..... *B24C 1/06* (2013.01); *B05D 3/002* (2013.01); *B05D 3/12* (2013.01); *B24C 1/04* (2013.01); *B24C 11/00* (2013.01); *B05D 5/02* (2013.01); *Y10T 428/24479* (2015.01)

(58) Field of Classification Search

CPC . B05D 3/002; B05D 3/12; B05D 5/00; B05D 5/02; B24C 1/04; B24C 1/06; B24C 11/00

USPC ..... 427/289, 290, 299, 322

See application file for complete search history.

(56) References Cited

U.S. PATENT DOCUMENTS

| | | | |
|---|---|---|---|
| 504,543 | A | 9/1893 | Suess |
| 1,720,568 | A | 7/1929 | Philip |
| 1,784,495 | A | 12/1930 | O'Neill |
| 1,869,695 | A | 8/1932 | Jellow et al. |
| 2,065,406 | A | 12/1936 | Silverman |
| 2,106,979 | A | 2/1938 | Kavanaugh |
| 2,109,000 | A | 2/1938 | Waldo, Jr. |

(Continued)

FOREIGN PATENT DOCUMENTS

| | | | |
|---|---|---|---|
| JP | 05-261717 | A | 10/1993 |
| JP | 2003-193686 | A | 7/2003 |

(Continued)

OTHER PUBLICATIONS

Author Unknown, Sep. 23, 2007, Modern Phoenix Online Forum, Stucco Picture.

(Continued)

*Primary Examiner* — Kirsten Jolley

(74) *Attorney, Agent, or Firm* — Wolf, Greenfield & Sacks, P.C.

(57) ABSTRACT

A panel including a surface made of a synthetic material may be subjected to a material removal process to create a specific decorative or architectural appearance. In one embodiment, a panel of cellular PVC is blasted with an abrasive material such as crushed glass to create a realistic stucco appearance on the panel surface. Benefits related to using certain synthetic materials as cladding may be realized, such as weather resistance. A coating containing aggregate may be applied to the blasted panel to enhance the surface appearance.

14 Claims, 10 Drawing Sheets

(56) References Cited

U.S. PATENT DOCUMENTS

| | | | | |
|---|---|---|---|---|
| 2,162,332 | A | 6/1939 | Frick | |
| 2,358,710 | A | 9/1944 | Helgeson | |
| 2,706,355 | A | 4/1955 | Brown | |
| 2,791,289 | A * | 5/1957 | Meissner | E04B 1/8227 181/293 |
| 3,579,926 | A | 5/1971 | Gaspari | |
| 3,585,699 | A | 6/1971 | Shuttle | |
| 4,021,401 | A | 5/1977 | Jeppsen | |
| 4,133,919 | A | 1/1979 | Parsons | |
| 4,199,358 | A | 4/1980 | Parsons | |
| 4,443,500 | A | 4/1984 | deJori | |
| 4,702,786 | A | 10/1987 | Tallman | |
| 4,834,833 | A | 5/1989 | Palmer | |
| 4,997,687 | A | 3/1991 | Carter | |
| 5,112,406 | A | 5/1992 | Lajoie et al. | |
| 5,130,374 | A | 7/1992 | Cozens et al. | |
| 5,167,991 | A * | 12/1992 | Lowe | B28B 11/00 427/267 |
| 5,308,403 | A | 5/1994 | Yam et al. | |
| 5,422,399 | A | 6/1995 | Cozens et al. | |
| 5,435,770 | A | 7/1995 | Balentine | |
| 5,535,563 | A | 7/1996 | Brown et al. | |
| 5,634,307 | A | 6/1997 | Larriberot et al. | |
| 5,785,904 | A | 7/1998 | Abou-Rached | |
| 5,827,114 | A | 10/1998 | Yam et al. | |
| 5,998,525 | A | 12/1999 | Wang et al. | |
| 6,012,975 | A | 1/2000 | Jager | |
| RE37,186 | E | 5/2001 | Hill | |
| 6,533,643 | B1 | 3/2003 | Feng | |
| 6,974,502 | B2 | 12/2005 | Schmidt | |
| 7,022,202 | B2 | 4/2006 | Goertzen | |
| 7,037,958 | B1 | 5/2006 | Hansen et al. | |
| 7,204,060 | B2 | 4/2007 | Hunt | |
| 7,207,869 | B2 | 4/2007 | James | |
| 7,229,342 | B1 | 6/2007 | York | |
| 2004/0080461 | A1 | 4/2004 | Rothgeb et al. | |
| 2005/0191466 | A1 | 9/2005 | Andrade | |
| 2005/0210808 | A1 * | 9/2005 | Larson | B32B 27/12 52/555 |
| 2006/0069198 | A1 * | 3/2006 | Okuda | C08F 283/12 524/457 |
| 2007/0144100 | A1 | 6/2007 | Andrade | |
| 2008/0236079 | A1 * | 10/2008 | MacKinnon | B24B 1/007 52/311.1 |
| 2010/0058691 | A1 | 3/2010 | Mannion | |

FOREIGN PATENT DOCUMENTS

| | | | |
|---|---|---|---|
| KR | 10-0596731 | B1 | 7/2006 |
| KR | 10-2007-0081292 | A | 8/2007 |

OTHER PUBLICATIONS

Thomas et al. "The Influence of Blowing Agent Type on the Properties of Extruded PVC Foam" *Cellular Polymers* (1993) Paper 8, pp. 1-9.

Defife, "The Determination of PVC Resin Porosity and its Correlation with Compounding and Processing" *Journal of Vinyl Technology*, Jun. 1980, vol. 2, No. 2, pp. 95-99.

Burt, "The Elements of Expansion of Thermoplastics Part II", *Journal of Cellular Plastics*, Nov./Dec. 1978, vol. 14, No. 6, pp. 341-345.

"Walnut Soft Abrasive Grit", http://www.dennisdawson.com/walnut.htm.

"Ultrahigh-Pressure Waterjets Eases Environmental Concerns", FLOW, http://www.flowcorp.com/waterjetresources.cfm?id=521.

"Moisture intrusion: Stucco problem or construction problem?" Stucco in Residential Construction, a publication of the Minnesota lath & plaster bureau, pp. 1-23.

"Tapes for Grit Blasting", Engineering Solutions for all Industries, http://www.viadon.com/tapes4.htm, Feb. 18, 2008.

"Polymer and Thermal spray Applications", http://www.strongholdone.com/liquidmask.htm, Copyright 2006 Stronghold Coatings, Ltd.

International Preliminary Report on Patentability from corresponding International Application No. PCT/US2010/000484, dated Aug. 23, 2011.

International Search Report and Written Opinion for International Application No. PCT/US2010/000484 mailed Sep. 28, 2010.

* cited by examiner

CLADDING HAVING AN ARCHITECTURAL SURFACE APPEARANCE

CROSS-REFERENCE TO RELATED APPLICATIONS

This application is a divisional application of U.S. patent application Ser. No. 12/709,332, filed Feb. 19, 2010, which claims priority under 35 U.S.C. §119(e) to U.S. Provisional Patent Application Ser. No. 61/154,270, filed Feb. 20, 2009, each of which is incorporated herein by reference in its entirety.

FIELD OF THE INVENTION

Embodiments of the invention disclosed herein generally relate to enhancing the surface appearance of various materials. More specifically, embodiments described herein relate to materials, such as synthetic materials, which are modified to imitate an architectural surface texture.

BACKGROUND

Stucco is an attractive and durable cladding or exterior finish for surfaces of various structures, including, for example, commercial buildings and residential houses. The installation of stucco often involves or requires the application of three separate layers, and can be labor intensive. Due to preferred weather conditions for installation, in some climates stucco can be applied only at certain times of the year or only when favorable weather conditions are forecast. In other climates, the installation of stucco is difficult or not recommended.

Various other coatings and decorative finishes for architectural elements, such as cut stone and brick are desirable from an aesthetic standpoint, but installation issues, materials availability and durability may hinder their use in certain settings.

SUMMARY

The use of synthetic materials as wall, ceiling or roof cladding can be beneficial in terms of ease of installation and overall durability. For example, panels made of synthetic materials can be fabricated at a factory and then installed as siding on a house. In this manner, the amount of time required for installation on site can be reduced as compared to applying a cladding which relies on a multi-step installation procedure, such as those required by typical stucco applications. Synthetic materials also can be selected or formulated to withstand various weather conditions, and the specific material formulations may be targeted for certain geographical areas based on factors such as humidity, rainfall, UV intensity, temperature, and/or other factors.

Embodiments of the invention provided herein are directed to panels used as cladding for structures, such as cladding for walls (whether interior or exterior), and ceilings, as just two examples. Methods of manufacturing and/or installation of panels are also disclosed herein. According to one aspect of the invention, a synthetic cladding is manufactured by subjecting a synthetic substrate to a material removal process such as abrasive blasting, water jet cutting, slurry blasting, non-abrasive blasting, or dry ice blasting, as several examples. The removal process is administered in such a manner as to produce a desired surface texture or appearance. For example, in some embodiments, a substrate such as polyvinyl chloride (PVC) (cellular PVC in some embodiments) is modified to appear as a stucco finish.

In some embodiments, wet and/or dry blasting is used to remove material from the synthetic substrate, and the resulting panel has recesses of varying depths and varying shading. After the blasting operation, the panels may be installed as cladding on a structure. In other embodiments, panels may be installed on a structure, and blasting (and/or other processes) may be performed subsequent to the panel installation.

According to one embodiment of the invention, an apparatus for creating panels having an architectural surface includes a panel support constructed and arranged to hold a panel having a surface, and a blaster having a blasting nozzle and configured to propel blasting material at the panel surface when the panel is held in the panel support, at least one of the panel and the blaster nozzle being movable relative to the other of the panel and the blaster nozzle. The apparatus further includes a template including openings, the template being positionable between a blaster nozzle and the panel support.

The apparatus may further include a panel configured to be held in the panel support. The panel may include a synthetic material. The template openings may have an irregular perimeter. The template openings may be shaped such that blasting a panel by propelling blasting material through the template openings forms a stucco appearance on a surface of the panel. The apparatus may further include a controller configured to control parameters of the blaster. The apparatus may further include a controller configured to control the relative positioning of the blaster nozzle and the panel. The template openings may be shaped such that blasting a panel by propelling blasting material through the template openings forms a stucco appearance on a surface of the panel.

According to another embodiment of the invention, a panel has a surface comprising a synthetic material and has an architectural surface appearance. The panel is formed by acts of providing a panel having a surface which comprises a rigid synthetic material, and removing portions of the rigid synthetic material to create an architectural surface finish appearance on the panel. In some embodiments, the panel has a stucco finish appearance formed by removing portions of the rigid synthetic material.

The act of removing portions of the rigid synthetic material may include propelling blasting material at the portions of the rigid synthetic material. The panel may be formed by a further act of positioning a template between a blasting nozzle and the panel surface, the template having openings with irregular perimeters. A bottom surface of the recess may include peaks and valleys, wherein a height difference between a highest peak from among the peaks and a lowest valley from among the valleys is greater than one sixteenth of an inch.

According to a further embodiment of the invention, a method includes providing a panel having a surface which comprises a rigid synthetic material, and removing portions of the rigid synthetic material to create an architectural surface appearance on the panel. In some embodiments, the method includes removing portions of the rigid synthetic material to create a stucco finish appearance on the panel.

In the embodiment of the above method, removing portions of the rigid synthetic material includes removing a portion of the rigid synthetic material to form a recess having a tortuous perimeter. A bottom surface of the recess may include peaks and valleys, wherein a height difference between a highest peak from among the peaks and a lowest valley from among the valleys is greater than one thirty-second of an inch. The height difference between the highest peak and the lowest valley may be greater than one sixteenth of an inch. The height difference between the highest peak and the lowest valley may be less than one half inch. Removing portions of the rigid synthetic material to create a stucco finish appearance may include positioning a template between the panel surface and a blaster, the template including openings, and operating a blaster to propel blasting material at the panel surface through the openings, wherein the template prevents the blasting material from contacting areas of the panel surface. Operating the blaster to propel blasting material may include operating the blaster to propel one or more of crushed glass, an abrasive blasting material, or a nonabrasive material. Operating the blaster to propel blasting material may include one or more of pneumatic blasting, hydraulic media blasting, slurry blasting, or dry ice blasting. The panel surface may include PVC, such as cellular PVC. The method may further include applying a coating to the panel after removing portions of the rigid synthetic material. The coating may include a liquid mixed with aggregate. The aggregate may include solid blasting material previously used in a blasting operation. The aggregate may include crushed glass. Removing portions of the rigid synthetic material may include removing a portion of the rigid synthetic material to form a recess having approximately perpendicular sidewalls. Removing a portion of the rigid synthetic material may include blasting the synthetic material with a solid blasting material. Blasting the synthetic material with a solid blasting material may include blasting the synthetic material with a mixture of the solid blasting material and a liquid.

According to one embodiment of the invention, a panel includes a panel surface having recesses with irregular outlines and varying depths, and a coating including an aggregate of crushed glass. The coating and the irregular recesses create an appearance of a stucco finish.

In the panel of the embodiment described above, the panel may include a synthetic material. The panel may include an engineered material. A bottom surface of the recess may include peaks and valleys, wherein a height difference between a highest peak from among the peaks and a lowest valley from among the valleys is greater than one thirty-second of an inch. The height difference between the highest peak and the lowest valley may be greater than one sixteenth of an inch. The height difference between the highest peak and the lowest valley may be less than one half inch.

According to another embodiment of the invention, an apparatus includes a panel support constructed and arranged to hold a panel having a surface, and a blaster configured to propel blasting material at the panel surface when the panel is held in the panel support, at least one of the panel and the blaster being movable relative to the other of the panel and the blaster. The apparatus further includes a controller configured to control the relative positioning of the blaster and the panel, wherein the controller is configured to control the relative positioning of the blaster and the panel such that blasting the panel surface creates a stucco finish appearance on the panel.

In the apparatus of the embodiment described above, the apparatus may further include a template that is positionable between the panel and the blaster, the template including openings having irregular and angular perimeters. The controller may be configured to control the relative positioning of the blaster and the panel at least partially based on a randomly determined parameter. The apparatus may further include a panel. The panel may include a synthetic material. The panel may include an engineered material.

According to a further embodiment of the invention, a coating includes a liquid medium and an aggregate that has been burnished by being used as a blasting material. In the coating, the aggregate may have been burnished by being used as a blasting material to remove synthetic material from a panel having a surface which comprises the synthetic material. The aggregate may include crushed glass. The liquid medium may include latex paint.

According to another embodiment of the invention, a method of installing cladding on a structure includes positioning a template between a blaster nozzle and a surface of a panel, the panel surface comprising a synthetic material, and the template including openings which leave portions of the panel surface exposed. The method also includes operating a blaster to propel blasting material from the blaster nozzle to the portions of the panel surface left exposed by the template openings, wherein the blasting material forms recesses in the panel surface, and installing the panel as cladding on a structure.

In the method of the embodiment described above, the act of installing the panel as cladding on a structure may be performed before the act of operating the blaster. The act of operating the blaster may be performed before the act of installing the panels. The blasting material may form recesses in the panel surface that provide a panel having a stucco appearance. The method may further include applying a coating over the panel surface after the act of operating the blaster. The method may further include applying a coating over the panel surface after the act of operating the blaster. Operating the blaster may include operating the blaster manually. Operating the blaster may include using a controller which operates based on computer-readable instructions.

According to a further embodiment of the invention, a method of manufacturing a plurality of panels for use as cladding for a structure includes, for each of a plurality of panels having a surface comprising a synthetic material, positioning at least one of a plurality of templates between the panel surface and a blaster nozzle to leave portions of the panel surface exposed, and propelling a blasting material at the exposed portions of the panel surface. Each template of the plurality of templates has a different arrangement of openings as compared to the other templates. Additionally, for each panel, a each template has a different arrangement of openings as compared to others of the templates.

In the method of the embodiment described above, the blasting material may form a stucco appearance on the panel surface. The panel surface may include cellular PVC. The method may further comprise controlling a shape of the blaster nozzle to control the blasting material.

According to another embodiment of the invention, a method including providing a panel having a surface which comprises a rigid synthetic material, and removing portions of the rigid synthetic material to create an architectural finish appearance on the panel.

In the method of the embodiment described above, removing portions of the rigid synthetic material may include using a blasting process to blast the panel. The method may further include positioning a template between a blasting nozzle and the rigid synthetic material, the template having a pattern of openings configured to provide the architectural finish appearance on the panel once the panel is blasted.

According to another aspect of the invention, a structure includes a synthetic panel as cladding, with the panel including recesses formed by a material removal process. The synthetic material may be PVC, and the material removal process may be a blasting method, such as slurry blasting, dry blasting with crushed glass, sand, or other suitable material, or water jet cutting.

According to yet another aspect of the invention, cellular PVC panels are manufactured and installed as exterior wall cladding. After installation, the panels are blasted to create a stucco appearance. When installed, a coating including an aggregate may be applied over the surface of the panels, and this coating may cover the seams between the panels to hide, or at least reduce the visibility of the seams, and/or hide penetrations in the panels (e.g., holes used as part of installing the panels). The application of a coating also may improve the overall appearance of the installation, and may improve its resemblance to a stucco finish.

BRIEF DESCRIPTION OF THE DRAWINGS

Other advantages, novel features, and uses of the invention will become more apparent from the following detailed description of non-limiting embodiments of the invention when considered in conjunction with the accompanying drawings, which are schematic and which are not intended to be drawn to scale. For purposes of clarity, not every component is labeled in every figure, nor is every component of each embodiment of the invention shown where illustration is not necessary to allow those of ordinary skill in the art to understand the invention.

DETAILED DESCRIPTION OF THE INVENTION

Figure 1A:
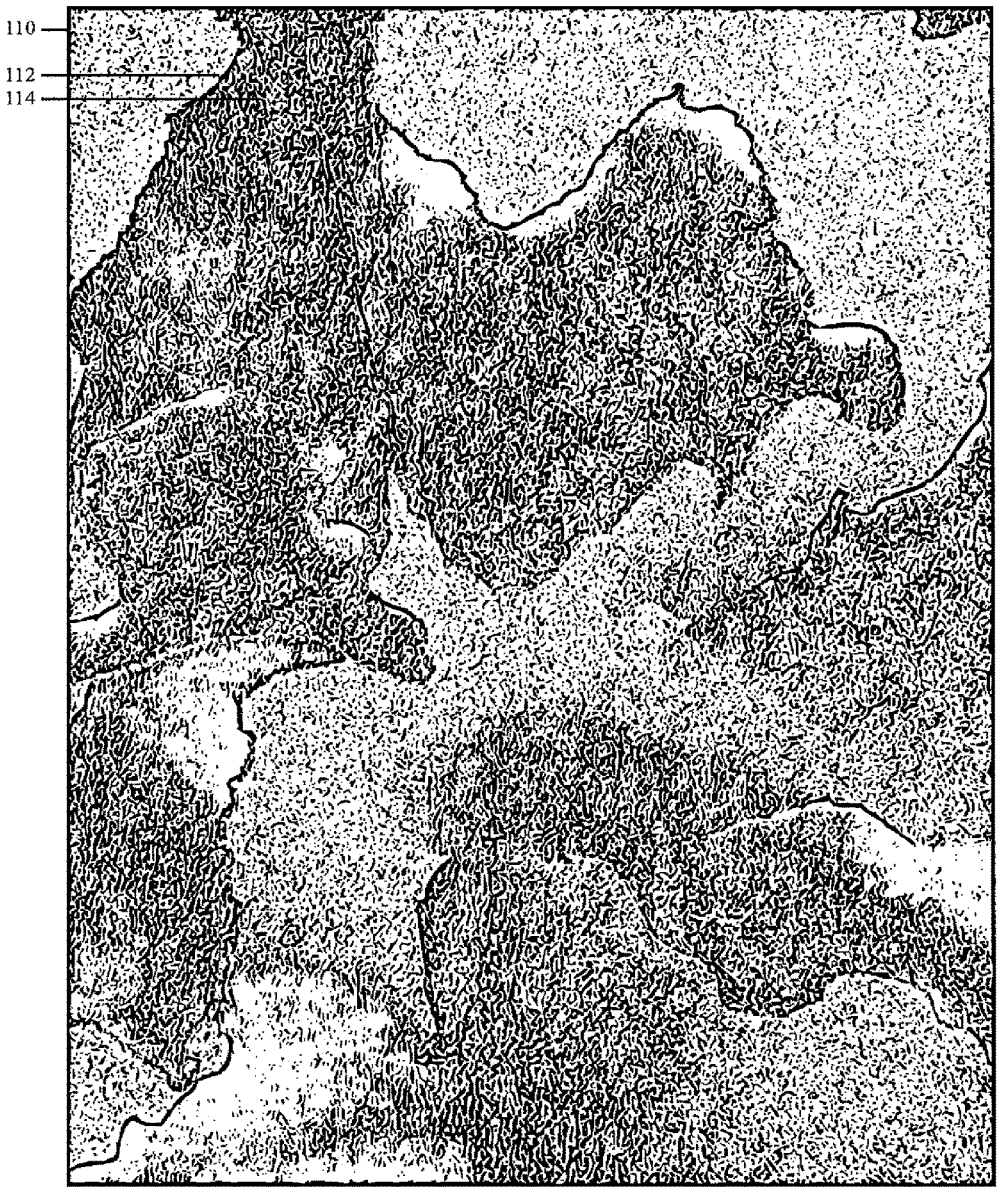
FIGS. 1*a*-1*d* show various examples of synthetic panels having a stucco appearance.
Figure 1B:
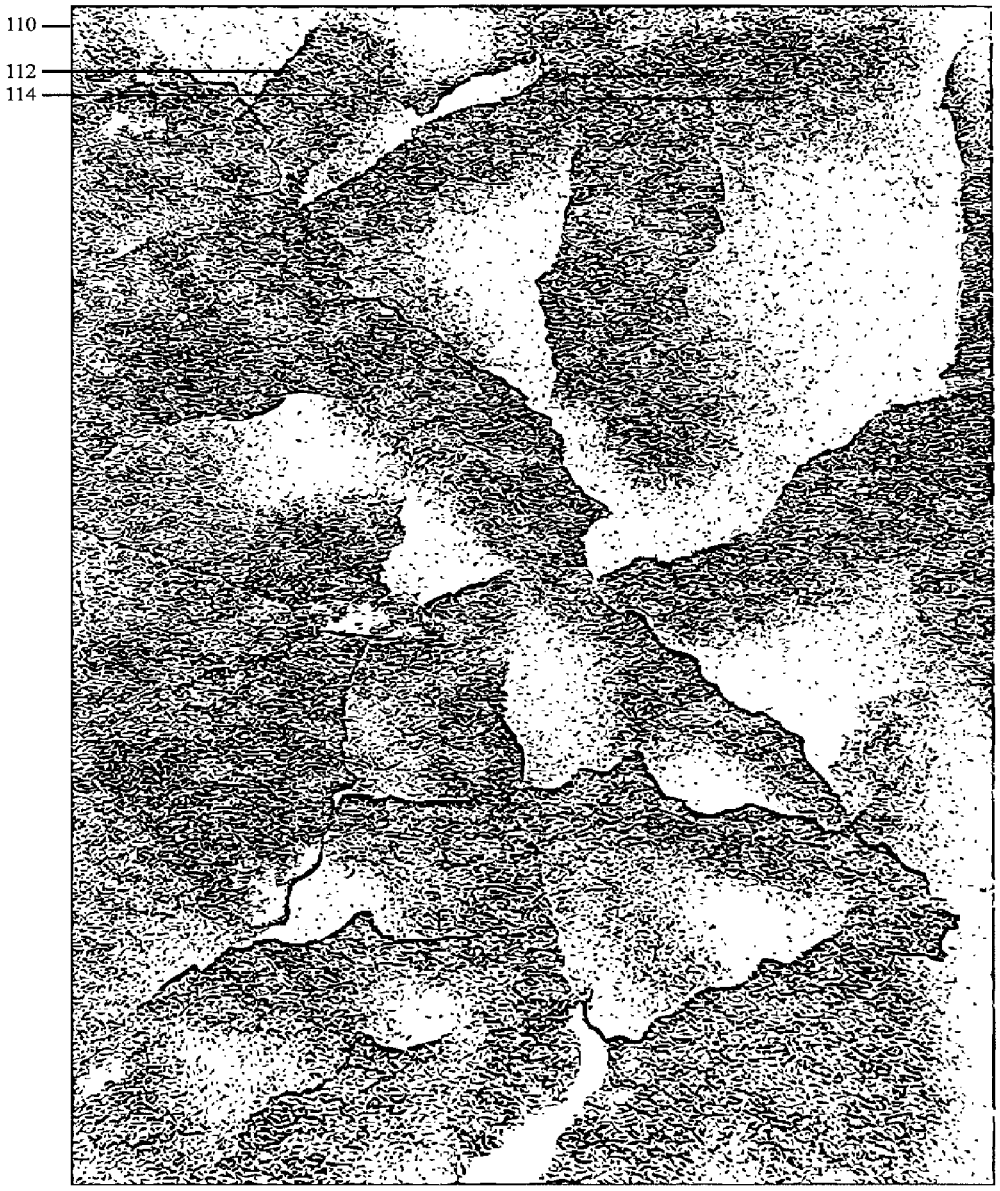
Figure 1C:
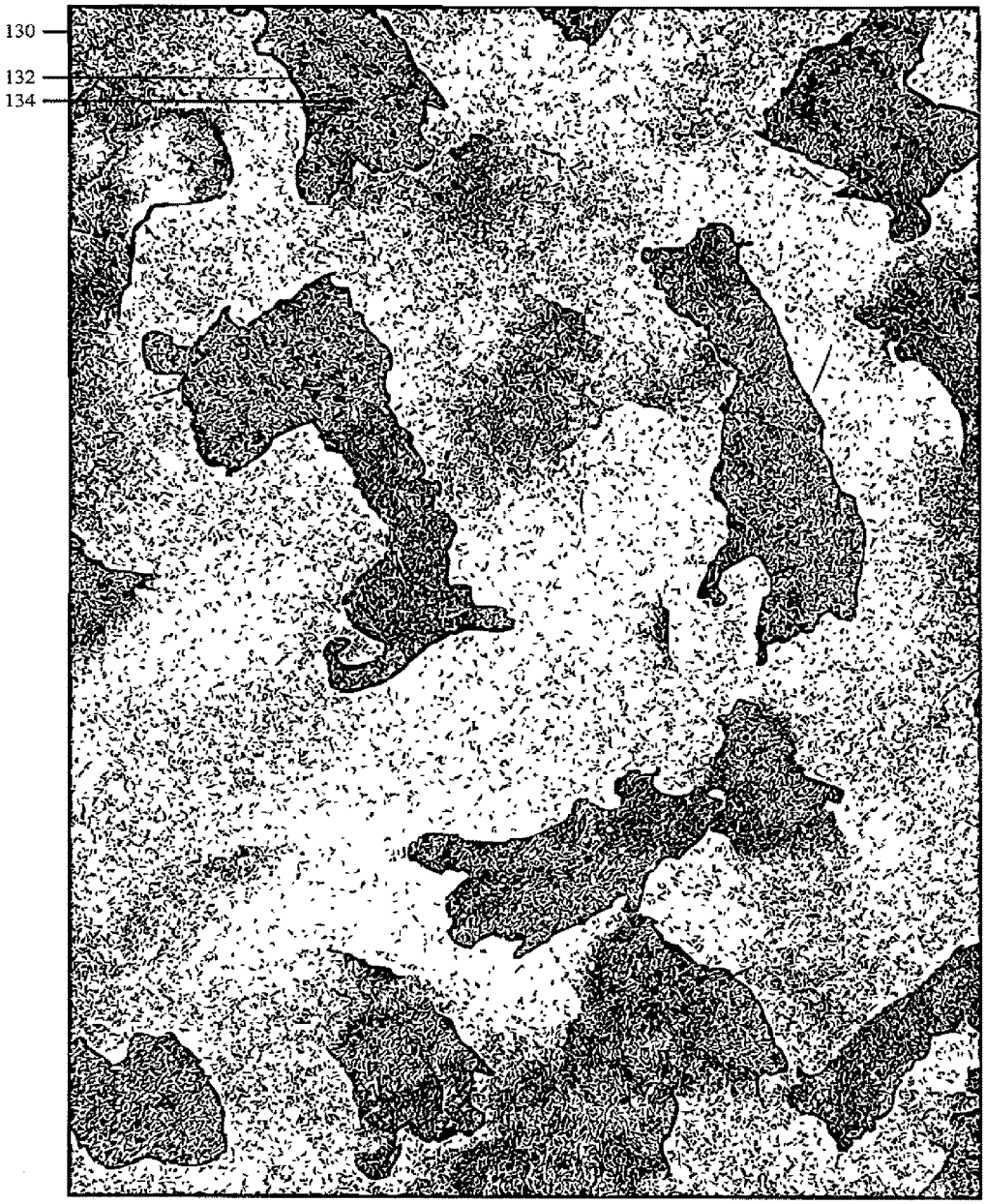
Figure 1D:
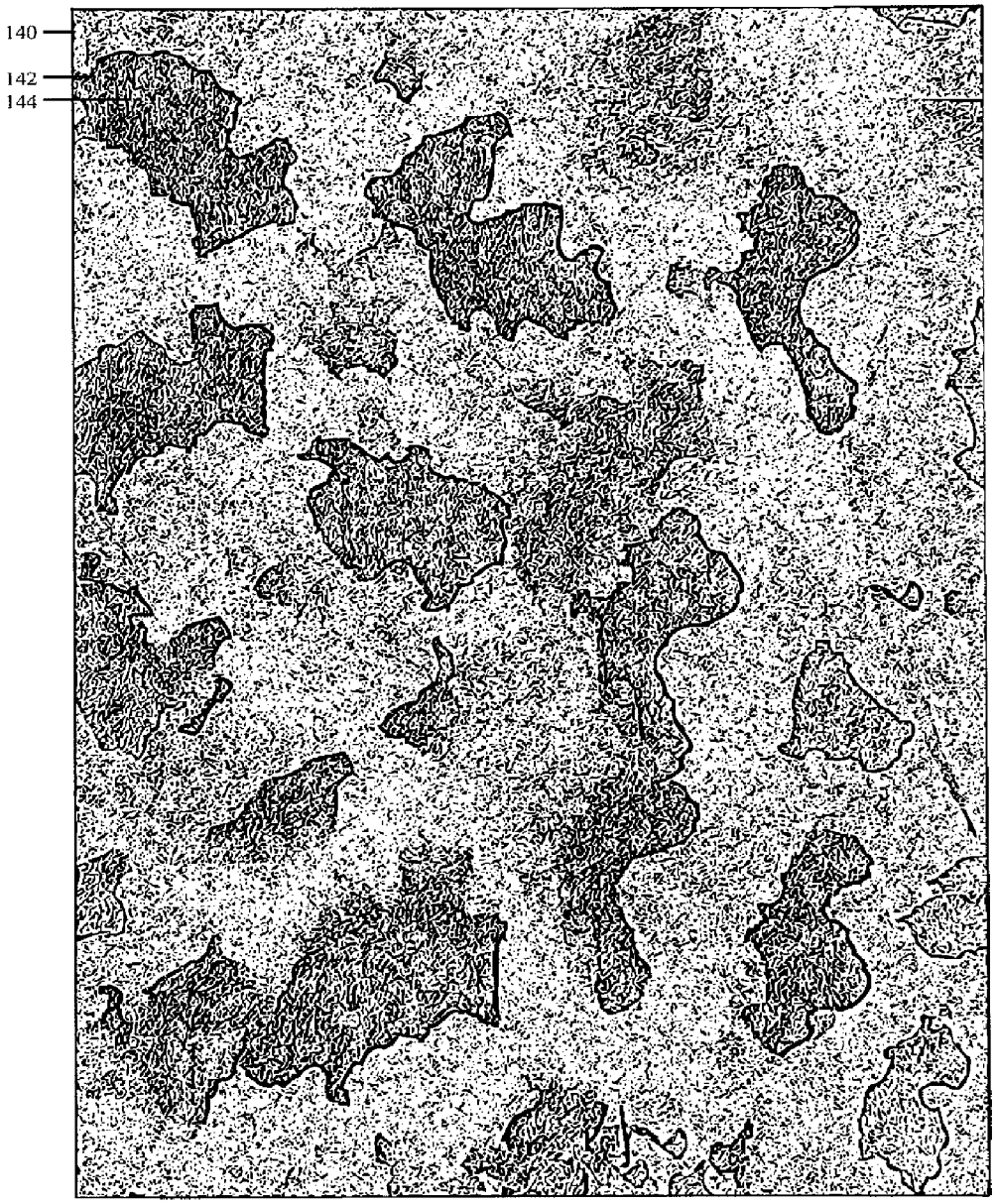

For ease of understanding, and without limiting the scope of the invention, the claddings and methods to which this patent is addressed are disclosed below particularly in connection with panels that are used as exterior wall claddings on structures such as residential buildings. It should be appreciated, however, that embodiments of the present invention can include claddings other than panels, and panels disclosed herein may be used for suitable applications other than as claddings.

To create a specific decorative or architectural appearance, a sheet of synthetic substrate may be subjected to a material removal process. In this manner, various decorative appearances for claddings may be created in a factory setting, which may aid in achieving a consistent appearance for large numbers of panels. As one example, a sheet of rigid cellular PVC may be blasted with an abrasive material such as crushed glass to create a realistic stucco appearance on the panel surface, for example an appearance of hand-trowelled stucco. Additionally, benefits related to using certain synthetic materials as cladding may be realized, such as weather resistance. Other methods of creating claddings with various surface appearances or textures are described further below.

Various decorative appearances and/or textures may be created using methods described herein. For example, cut stone, brick, or other masonry-type designs may be created. In some embodiments, the material removal process may create a stucco appearance on a panel or other substrate. Genuine stucco surfaces typically have a rough texture and have valleys and peaks in a cross-sectional view. Some masonry-type surfaces have a repeating pattern or other structured appearance, for example, a brick-like appearance. Other decorative appearances present a more natural and/or random look. A quality stucco appearance, whether or not created by a process that incorporates an element of randomness, and whether created by a genuine stucco application method or by the use of another method, often gives the impression of having been created by a non-automated process. It should be noted, however, that certain embodiments herein use an automated process and may not incorporate an element of randomness, and said embodiments may still be considered as having a stucco appearance.

Examples of stucco textures that may be imitated using methods disclosed herein include, but are not limited to, sand float, light dash, heavy dash, cat's face, californian, knockdown, tunnel, simulwood, monterey, sand, lace, heavy lace, skip trowel, and many other textures.

Four different examples of planar panels 110, 120, 130, 140 having a stucco appearance are shown in FIGS. 1*a*-1*d*. In each illustrated embodiment, a perimeter 112, 122, 132, 142 of each recess 114, 124, 134, 144 is irregular. Additionally, the depths of the recesses vary within each recess and from recess to recess. Further, the shading of the bottom of the recesses is shown as varying in FIGS. 1*a*-1*d*. This variation in shading may be achieved by varying the hold times of a blaster over certain areas of the panels 110, 120, 130, 140. For example, when using an abrasive blasting method, the abrasive material(s) may cauterize the synthetic panel material, leading to a darkening of the synthetic material. The dwell time of the blaster over various areas of the panel may differ so that different levels of cauterization are achieved. As shown in FIGS. 1*a*-1*d*, perimeters of the recesses may be tortuous.

Figure 8:
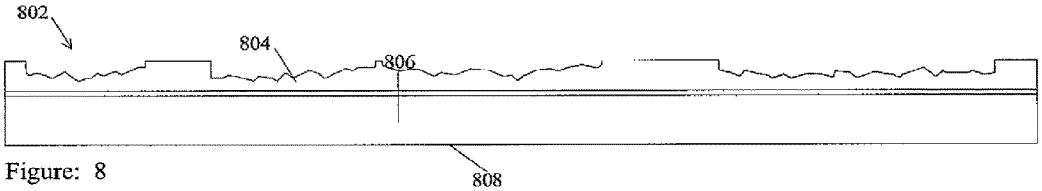
FIG. 8 is a cross-sectional side view of one embodiment of a laminate including a synthetic panel bonded to a support substrate.

Various types of synthetic substrate materials may be used. In some embodiments, a substrate comprising more than one material may be used, and in still further embodiments, synthetic surface materials may be attached to a support substrate (either synthetic or natural), as described further below with reference to FIG. 8. PVC panels may be formed with extruded PVC sheets which are subsequently operated on with a material removal process to present a different appearance. A rigid PVC sheet with a thickness of ⅜" may be used in some embodiments, although any suitable thickness may be used depending on various factors such as weight, durability, strength, cost, depth of material removal, installation considerations, and/or other factors. Examples of commercially-available cellular PVC products include, but are not limited to: Azek, Duraboard, Gossen Techtrim, Fypon, Kleer, Koma, Nels-Tek, and Versatex brand products. Examples of other synthetic substrate materials which may be used include, but are not limited to: Carvagio Polyurethane Foam, Duna Corafoam HDU, Duron, Fome-Cor, Gatorfoam, Gatorplast, Scooter Board, Signfoam 3, Structa-Board, Ultra Board, and Ultra Mount Foam Board brand products.

Polystyrene, nylon, vinyl, and other plastic sheets either on their own or laminated to other materials also may be used with embodiments herein.

A cementatious (cement) or a gypsum board also may be used to achieve benefits of masonry-based cladding. These types of boards may include commercially-available cementatious sheet/board products as well as customized boards formulated for particular characteristics such as climate-specific weather resistance, or high strength-to-weight ratios.

In some embodiments, engineered materials which are partially or fully composed of natural materials may be used. For example, plywood sheets, concrete, MDO (Medium Density Overlay), MDF (Medium Density Fiberboard), Oriented Strand Board (OSB), or hard board may be used with embodiments herein.

For purposes herein, the term "panel" is not limited to substantially planar elements, and is intended to encompass curved three-dimensional elements in addition to substantially planar elements. A curved cladding element shaped as one quarter of a cylinder is considered to be a panel for purposes herein, for example.

Figure 2A:
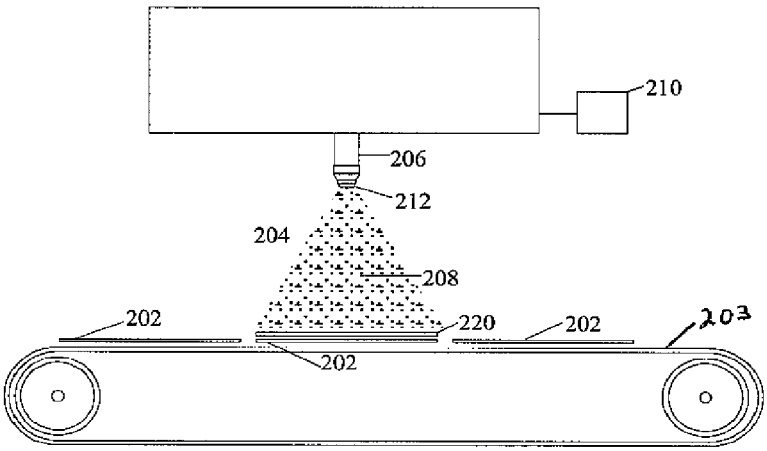
FIG. 2*a* illustrates one embodiment of a panel manufacturing system including a blaster.

Panels having various surface appearances, such as a stucco appearance, may be manufactured in a standardized setting, such as a factory, as shown in the embodiment of FIG. 2*a*. In the embodiment of FIG. 2*a*, individual panels 202 are fed to a blasting station 204 on a conveyor belt 203, where a blaster 206 propels a blasting material 208, such as crushed glass, at the panels from a blasting nozzle 212. In some embodiments, a template (see FIG. 2*b*) may shield portions of each panel 202 from the blasting material such that certain areas of the panel are do not have material removed. Any suitable panel support may be used, such as a conveyor belt or a stationary support, as the type of support used is not intended to be limiting.

The blaster may be held stationary in certain embodiments, and the panels are moved relative to the blaster to permit blasting of various areas of the panel. In some embodiments, instead of, or in addition to, moving the panels, the blaster may be movable to blast a portion or substantially all of the areas of the panels. A controller 210 may be adapted to control the movements of the blaster and/or panels, and also may be configured to control the magnitude and/or type of blasting which is applied to the panels. For example, controller 210 may alter the speed with which blasting material 208 is propelled at the panels, and controller 210 may select different densities or types of blasting materials, whether it be different abrasive media or different propellants in which the media is suspended. In some embodiments, controller 210 may control the shape of blasting nozzle 212.

For purposes herein, a blaster nozzle includes any outlet from a blasting apparatus through which blasting material can be propelled. Unless otherwise noted, the term blaster nozzle is not intended to connote a specific shape of an outlet. In various embodiments, different types of blaster nozzles may be used, including, for example, straight bore nozzles, wide throat nozzles, venturi bore nozzles, or angle nozzles.

An element of randomness may be incorporated into the panel production process to aid in achieving a realistic or natural surface appearance. For example, with stucco installations, it is not necessarily desirable to produce an obvious pattern of one or more elements (e.g., shape, depth, orientation, etc.) that repeat in such a way that the pattern or repetition can be readily detected by an observer who is not specifically looking for a pattern. Controller 210 may include a control program which at least partially randomizes certain aspects of the blasting, such as one or more of: blasting location; blasting magnitude; overall process intensity; blasting material type; blasting nozzle shape; and blasting dwell time. Of course, certain constraints may be put on the specific control of these aspects. By at least partially, or in some embodiments fully, randomizing one or more of these aspects (or other aspects) within certain constraints, the panels can be made to have a similar overall look without each panel having an identical pattern. The control program may randomize these aspects by basing its control instructions at least partially on a randomly determined parameter, such as a random number created by a random number generator.

Instead of a randomizing feature, controller 210 may include a control program that includes instructions for producing a large number of different types of panels. For example, controller 210 may have a separate blasting routine for fifty different panels. By using one of each panel on the side of a house, the overall construction can be made to have a consistent appearance without repeating patterns.

Figure 2B:
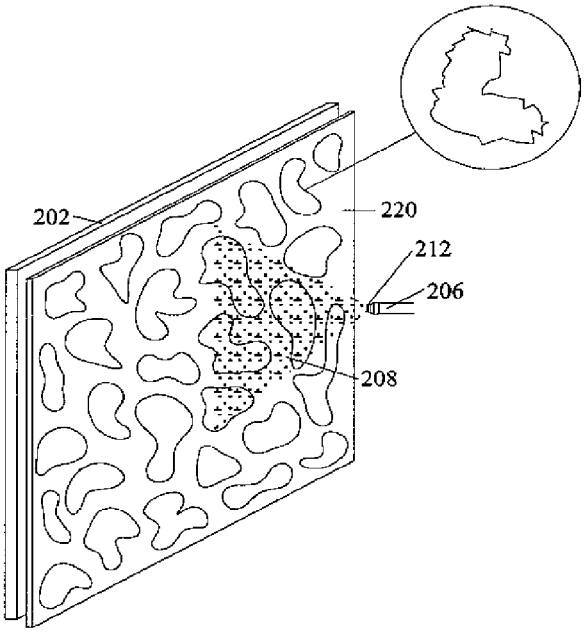
FIG. 2*b* illustrates one embodiment including the use of a template during manufacture.

FIG. 2*b* illustrates the use of a template 220 as part of a blasting method. Template 220 shields certain areas of panel 202 from the effects of the blasting such that portions of the panel remain smooth, at least initially. Openings 222 in template 220 allow blasting material 208 to reach panel 202 to remove material and create a textured surface. In embodiments intended to create the appearance of a stucco finish, the openings 222 may include angular, irregular, and/or tortuous sections along their perimeters. In one embodiment, template 220 is made of metal and is held stationary relative to panel 202 during blasting. In other embodiments, template 220 may be moved relative to panel 202 during blasting. Template 220 may be incorporated into a factory production setting, such as the embodiment of FIG. 2*a*, or, in some embodiments, template 202 may be used after panels have been installed on a structure (see FIG. 5 for example).

More than one template may be used for purposes of avoiding highly repetitive patterns. For example, instead of controlling blaster 206 to produce many different types of panels, blaster 206 may be operated in a nearly identical fashion from panel to panel, while varying templates may be inserted over the panels to produce different panels. Of course, a combination of blaster control and template selection may be used for even further variety. In some embodiments, templates may be layered on one another to produce varying shapes and sizes of template openings.

Figure 3A:
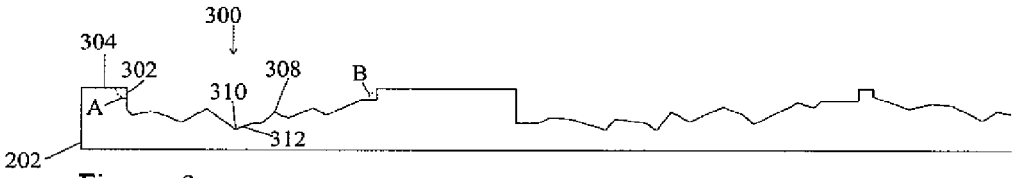
FIG. 3*a* is a cross-sectional side view of one embodiment of a synthetic panel with recesses formed by a material removal process.

The use of a material removal process, such as blasting, may permit the production of recesses that have sidewalls that are approximately perpendicular with the original panel surface and/or the bottom of the recess. Such a feature may contribute to a realistic stucco appearance and/or may result in strong shadow lines. For example, as shown in FIG. 3*a*, a recess 300 has a sidewall 302 which forms a ninety degree angle A with a top surface 304 of panel 306. Peaks 308 and valleys 310 throughout recess 300 may form various angles with a bottom 312 of recess 300, including an angle B of ninety degrees. Of course, sidewall 302 may form an angle with top surface 304 and/or recess bottom 312 that is different than ninety degrees.

Figure 3B:
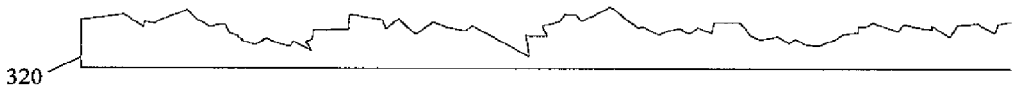
FIG. 3*b* is a cross-sectional side view of one embodiment of a synthetic panel with recesses formed by a material removal process.

The entire surface, or substantially the entire surface of a panel may be blasted, or otherwise have material removed, according to some embodiments. In the embodiment illustrated in FIG. 3*b*, the entire visible surface of a panel 320, that is, the surface that is intended to be visible once the panel is installed, has been blasted such that none of the original visible surface remains. In this manner, a panel may be formed which lacks any substantially flat areas that are parallel to the overall panel.

Some embodiments of panels having a stucco appearance include peaks and valleys (in a cross-section) on the visible surface of the panel, and the height difference between the top of the peaks and the bottom of the valleys is at least 1/32", and in some cases can be at least 1/16". In some embodiments, the height difference between the top of the peaks and the bottom of the valleys may be less than ½".

In one illustrative embodiment of a method and apparatus for imitating an architectural surface texture, a blaster is used in conjunction with a template, such as the template shown in FIG. 2*b*, to remove material from a panel. Using the template shown in FIG. 2*b* with the following blasting parameters can be used to form a stucco finish appearance on a panel such as a PVC panel. The parameters described in this example are not intended to be limiting, but instead show one embodiment of a method and an apparatus incorporating aspects disclosed herein. A SurfaceTek 1650 blasting pot manufactured by SurfaceTek Inc. of Tecumseh, Okla. is used with a compressor of 185 CFM or greater at a Pot pressure of between 65 psi and 110 psi, with an average of 90 psi. The blast hose pressure is maintained at 2%-5% below Pot pressure. A blasting nozzle of size 5 is used to blast media at a rate of between 0.5 and 3.5 pounds per minute. The blasting media may be #40 grit crushed glass when used in an automated setting. For manual blasting operations, #60/100 grit crushed glass may be used to reduce ricochet of the blast media toward the operator, especially when the panel being blasted has a high degree of surface elasticity.

The blasting nozzle is held at a distance of between ½" and 24" from the panel in this embodiment, and may be moved around to blast the panel exposed by each opening in the template. The blasting nozzle may be moved to a first opening and then controlled (either manually or by a controller) to move to different areas of the opening. The blasting nozzle may be move at rate of between ½" per second and 6" per second. The longer the dwell time of the blasting nozzle over a particular area results in a deeper removal of material as compared to a shorter dwell time. Of course, appropriate adjustments may be made to the above parameters if the process is scaled up or down.

One or more of many types of blasting may be used to remove material from the panels. For example, dry blasting, wet blasting (with or without abrasives), ultra-high pressure water jet blasting, or any other suitable blasting method may be used. Compressed air or frozen carbon dioxide ("dry ice") may be used as a propellant for blasting in some embodiments so that no blasting material remains for cleanup after blasting. Various abrasives may be used as part of the blasting process. Some examples of abrasives include: crushed glass; sand; walnut soft abrasive grit; aluminum oxide; white aluminum oxide; pumice; urea; polyester; melamine; silicone carbide; glass beads; steel grit; steel shot; cut wire shot; various metallic powders; sodium bicarbonate; potassium sulphate; coal slag; or any other suitable abrasive. The size and shape of the blasting media may be varied to achieve a variety of desirable surface characteristics. In some embodiments, the crushed glass may include crushed recycled bottles.

More than one blasting process may be performed on a single panel. A first pass may be performed using a first type of blasting or a first type of abrasive, and a second pass may be performed with a second, different type of blasting or a second, different type of abrasive. Further passes with other blasting materials and/or other types of processes may be performed. According to some embodiments, a template may be used during a first blasting process for a panel, and a second blasting process may be applied to the same panel without the use of a template. It should be noted that the first and second blasting processes may be performed in either order.

Figure 4A:
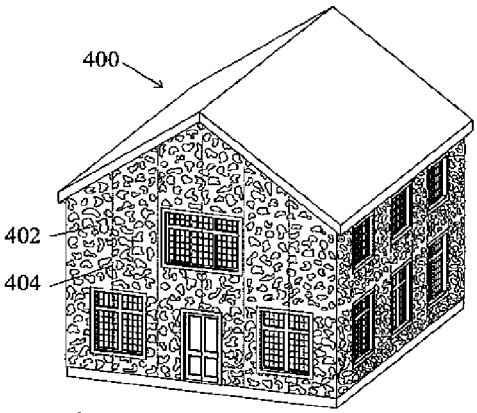
FIG. 4*a* illustrates one embodiment of a residential building having prefabricated synthetic panels installed as exterior wall cladding.
Figure 4B:
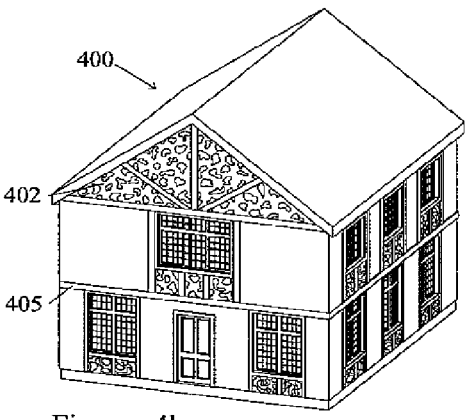
FIG. 4*b* illustrates another embodiment of a residential building having prefabricated synthetic panels installed as exterior wall cladding.

A completed structure 400 is shown in FIG. 4 with exterior synthetic panels 402 having a stucco appearance. Seams 404 are shown for illustrative purposes, but may be effectively hidden by a coating or other mechanism, as described further below with reference to FIG. 7. Panels may be cut to fit different areas on the structure, and panels of different sizes may be used for different areas of the structure. Panels may be constructed in any suitable size. For example, 12"×12" panels may be made for use in small areas or areas requiring custom shapes. For large areas, 4'×4' panels, 4'×8' panels, 4'×50' panels, or any other suitable size may be used. Panel size and shape may depend on typical sizes and shapes available for the particular material being used.

To address expansion and contraction of panels, suitably sized gaps may be provided between ends of the panels and windows, doors, etc. To hide these gaps, flashing, trim elements 405 and/or other features may be provided over the gaps.

In some embodiments, a coating may be applied to the exterior cladding to reflect solar heat and/or reduce the effects of UV light. A polymer wrap may be applied to the panels to create a surface that holds paint well in some embodiments.

Figure 5:
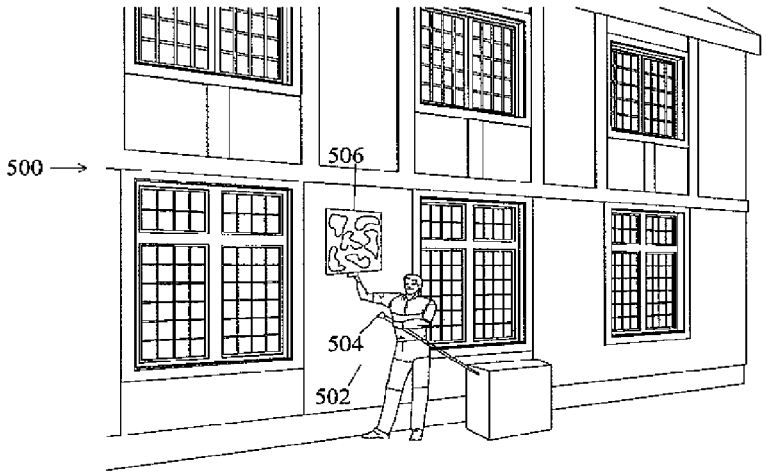
FIG. 5 illustrates one embodiment of a method of blasting synthetic panels after the panels have been installed as cladding.

Panels made of synthetic materials may be installed on a structure before completion of some or any of the surface texturing methods disclosed herein. For example, as shown in FIG. 5, panels 502 are installed on a wall 500. Subsequent to the installation of the panels, a hand-held blaster 504 may be used to create surface texture on the panels. The use of a hand-held blaster may lead to less consistency in the final result of the surface appearances as compared to machine-based panel production (e.g., the embodiment of FIG. 2*a*). However, an experienced craftsperson may be able to create a more organic and realistic look to the surface texture using a hand-held blaster or other human-controllable blaster. Additionally, individual tastes in appearance may be more readily addressed with human control as compared to an automated approach.

A template 506 may be used when blasting or otherwise operating on panels which have already been installed on as structure according to some embodiments. Template 506 may be the same size as a single panel, or, in some embodiments, may be smaller or larger than a single panel. Template 506 may be rotated into a different orientation for various panels to help achieve a non-repeating appearance, and of course, multiple, different templates may be used on the same structure. Specific templates may be produced for specific textures or other surface features.

Figure 6:
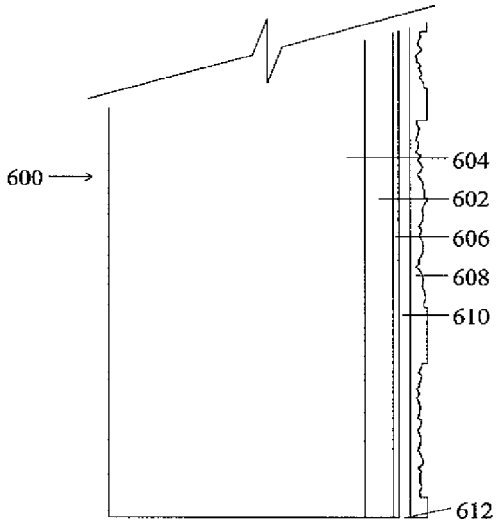
FIG. 6 is a cross-sectional side view one embodiment of a synthetic panel installed as cladding on a structure.
Figure 9A:
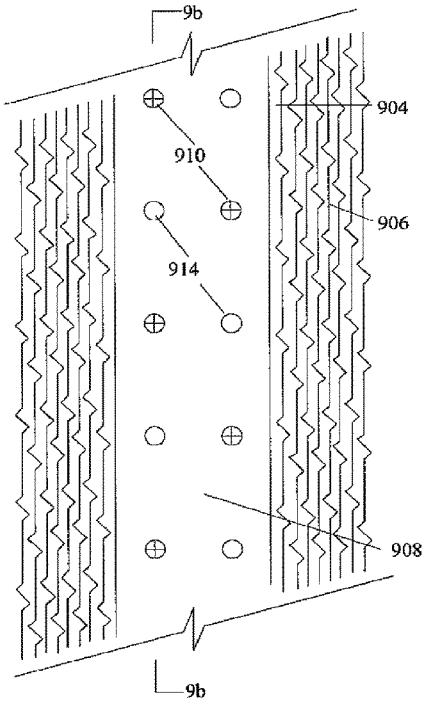
FIG. 9*a* is front view of one embodiment of a cleat panel used as part of installing panels.
Figure 9B:
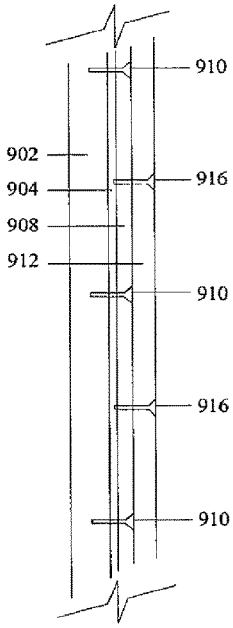
FIG. 9*b* is a cross-sectional view of one embodiment of a panel attached to a cleat panel.

One embodiment of installation details for a structure which has cladding made of panels described herein is illustrated in FIG. 6. A sheathing material 602, such as gypsum board, cement board, plywood, or any other suitable material, is attached to framing studs 604, which may be constructed of wood, metal, or other suitable material. A building wrap (e.g., a weather resistive bather) 606 is attached to sheathing material 602. The building wrap may be permeable or semi-permeable and may be constructed of any suitable material, such as builder's felt, Tyvek brand house wrap, or Typar brand house wrap as just three examples of many. An exterior synthetic panel 608 is attached to the structure with any suitable fastening system to form the outermost surface. One example of a panel fastening system is described further below with reference to FIG. 9. A drainage plane 610 is formed behind the exterior panel to permit drainage of moisture resulting from water penetration or water vapor migrating from the interior of the structure, which condenses between the building and its exterior cladding (e.g., from the wood structure) or collects from leaks in seams near windows, doors, flashing, etc. Vents 612 may be provided for such moisture to escape, for example at the bottom of the cladding.

Figure 7:
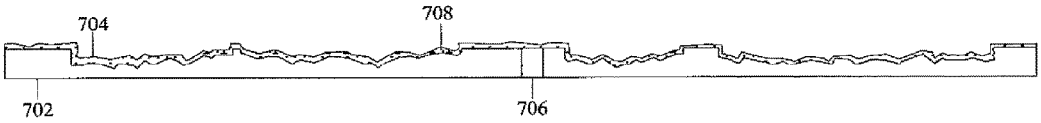
FIG. 7 illustrates one embodiment of a coating applied to seamed panels.

Seams between adjacent panels may be sealed with any suitable sealant, for example, a two-part epoxy or a structural acrylic adhesive manufactured by Bond & Fill of Taunton, Mass., or any other suitable sealant or adhesive. In some embodiments, as shown in FIG. 7, a coating 704 may be applied over panels 702 to help mask a seam 706 between the panels for improved aesthetics. Coating 704 may include a mixture of a latex paint and an aggregate 708, such as crushed glass or ground-up PVC, for example. In some embodiments, the crushed glass (or other material) used in the coating mixture may include crushed glass (or other material) that was used for abrasive blasting of the panels. During the blasting operation, the crushed glass may become burnished. In some embodiments, the coating may adhere better to burnished glass or other burnished aggregate material. In this manner, a by-product of the blasting operation may be re-used as part of the final product. When using a coating that includes blasting by-product, a primer or a paint that is compatible with a by-product of the blasting operation, but which does not itself include the by-product, may be applied to the panels as a first coat. A coating that does include the by-product of the blasting operation then may be applied as a second coat. In some embodiments, no coating, paint or primer is applied to the panels.

Crushed glass of various grits may be used in a coating, including, for example, 20 grit, 40 grit, 60 grit, 80 grit, 100 grit, 150 grit, or 200 grit. A coating may contain only one glass grit, or may contain two or more glass grits in the same or different proportions.

Reduced amounts of blasting may be used when a coating is added to the panel due to the texture that is added by the coating. Coating 704 does not require the use of a latex paint as other materials which are compatible with the panel material may be used to form the coating. Coating 704 may be applied on-site after panels are installed on a structure, or, in some embodiments, coating 704 may be applied during panel production in a factory.

For embodiments intended to create stucco appearances, some coatings may be formulated using two to five cups of crushed glass per gallon of paint, although any suitable ratio of aggregate to paint may be used. In one example, crushed glass is mixed with Sherwin Williams Duration brand exterior acrylic latex paint at a rate of two to five cups per gallon. In another example, when creating a medium or large cat's face stucco appearance, four to six cups of #60/100 grit crushed glass may be used per gallon of latex paint.

Various synthetic panels, such as cellular PVC, expand and contract with changes in temperature. Most of the expansion and contraction occurs in one direction, namely the direction in which the majority of polymers are oriented. To address this expansion and contraction, suitably sized gaps may be provided between ends of the panels and windows, doors, etc. To hide these gaps, flashing, trim elements and/or other features may be provided over the gaps. Additionally, as mentioned above, coatings that reflect solar heat may be added to the panels. By reducing the magnitude of short term temperature fluctuations experienced by the panels, the effects of environmental temperature and sunlight energy on the panels may be reduced.

To reduce the volume of synthetic material that is used to produce panels, a support substrate may be used. For example, in the embodiment shown in FIG. 8, a laminate is formed of a thin layer 804 (e.g., ¼" thick) of cellular PVC that is bonded to an exterior grade wood panel 806. The cellular PVC may be bonded to the wood panel with an adhesive 808, such as a structural acrylic adhesive or a polyurethane-based adhesive, although any suitable adhesive or bonding agent may be used. Other examples of support substrates which may be used to form a laminate include MDF, OSB, Corrugated metals, sheet metal, aluminum sheet, fiberglass panels, sheets or panels stabilized and reinforced by glass mats, fibers, corrugation, and mixed orientation, or any other suitable material. Synthetic materials other than cellular PVC may be used to form the synthetic layer, for example, one or more of the materials discussed further above as examples of synthetic substrates. Sheets and/or panels of varying or identical materials may be laminated to each other, orienting each sheet's or panel's principle dimension of expansion and contraction perpendicular to one another so as to reduce the rate of expansion and contraction in the component sheets. In the case of cellular PVC, the celuka foaming extrusion process results in the alignment of polymer chains in one dimension of the extrusion, namely lengthwise (across the length of the sheet). Laminating two sheets cellular PVC sheet so that they are oriented substantially perpendicular to one another may result in stabilization of the individual sheets.

Methods of installing panels as siding may vary according to a range of factors. For a seamed installation, that is, an installation where panels abut one another, according to one embodiment, the following method may be employed. On the outside of plywood sheathing 902 (see FIG. 9*b*) or other structural portion of a building, a weather resistant barrier 904 is attached. Mesh sections 906 (see FIG. 9*a*) are attached to the weather resistant barrier 904 and/or the plywood sheathing 902, leaving vertical gaps between the mesh sections for attachment of one or more cleat panels 908. Cleat panel 908 is secured to the plywood sheathing 902 to provide a raised surface onto which ends of siding panels 912 are attached (see FIG. 9*b*. Cleat panel 908 may be attached with any suitable fasteners 910, which may be countersunk. Cleat panel 908 may include pre-drilled holes 914 for receiving fasteners 916 which attach siding panels 912 may be attached to cleat panel 908. Any suitable fasteners 916 may be used to attach siding panels 912 to cleat panel 908, and the fasteners may be countersunk. The cleat panels are bonded (with an adhesive) to the cladding/skin panels further reinforcing the joint.

When the siding panels are attached to the cleat panels, the raised surfaces of the cleat panels create a drainage plane (containing mesh sections 906) behind the siding panels and outside of the plywood sheathing. The drainage plane allows moisture to escape from the structure, thereby helping to prevent problems associated with trapped moisture. Mesh or other suitable material maintains this plane between the cleat panels.

Cleat panel 908 may have the same, or substantially the same thickness as mesh 906, although in some embodiments they may have different thicknesses. In some embodiments, the cleat panels and the mesh have a thickness of ¼". Cleat panel 908 may be 3"-6" wide, although any suitable width may be used. The distance between co-linear fasteners 910 on the cleat panel may be any suitable distance, but in some embodiments, co-linear fasteners 910 are 4", 6", or 8" apart.

Cleat panels 908 may be spaced at any suitable distance from one another depending on specific installation requirements. In some embodiments, cleat panels 908 are spaced four feet apart. In some embodiments, cleat panels 908 are oriented vertically, while in other embodiments, they may be oriented horizontally. In some embodiments, the cleat panels are oriented perpendicular to the direction of primary thermal expansion of siding panels 912. For example, if panels 912 tend to expand and contract in the horizontal direction, cleat panels 908 may be oriented vertically and spaced apart regularly in the horizontal direction.

Figure 10:
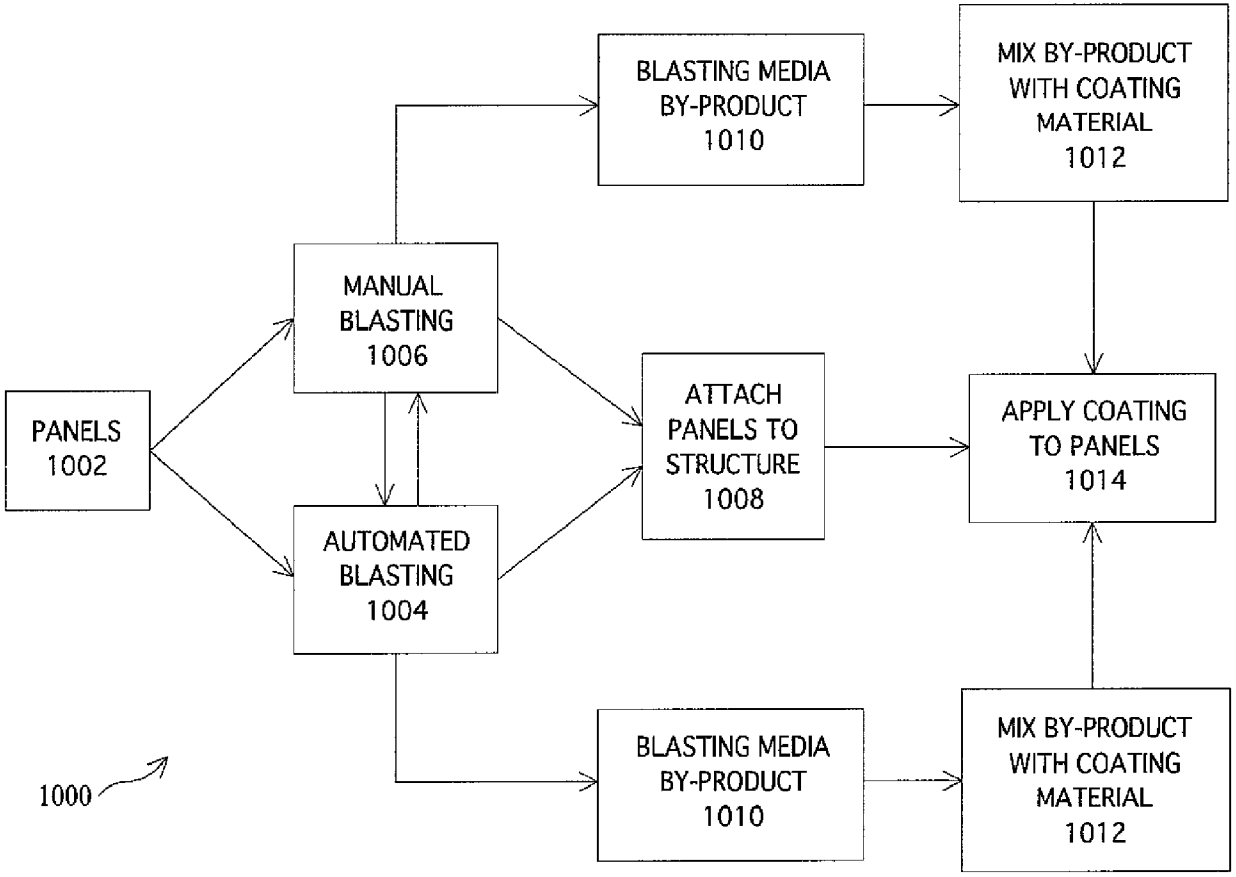
FIG. 10 shows a flowchart of methods of providing a cladding with an architectural appearance.

A flowchart 1000 showing methods of providing a cladding with an architectural appearance is shown in FIG. 10. Panels 1002, such as panels which include a synthetic material are subjected to one or both of an automated blasting process 1004 and a manual blasting process 1006. In some embodiments where both blasting processes are performed, manual blasting process 1006 may be performed first, and in other embodiments, automated blasting process 1004 may be performed first. One or more templates may be used as part of automated blasting process 1004 and/or manual blasting process 1006. Multiple manual blasting processes 1006 and/or multiple automated blasting processes 1004 may be performed on a single panel in some embodiments.

In an act 1008, the panels are attached to a structure. As noted further above, in some embodiments, panels may be attached to a structure before blasting is performed on the panels. In still further embodiments, blasting may be performed before and after attaching the panels to a structure. In some embodiments, additional blasting may be performed after attaching panels to a structure in order to "touch-up" certain areas.

A blasting media by-product 1010 resulting from either or both of automated blasting process 1004 and manual blasting process 1006 may be mixed with a coating material in an act 1012. The coating material may be applied to installed panels in an act 1014, in some cases to help hide seams between panels or other features of panel mounting. As discussed above, the coating may improve the overall appearance of the panels, and may further add to the appearance of a stucco finish, or other architectural element appearance. The particular blasting media by-product 1010 that is mixed with the coating material in act 1012 does not have to be the media by-product formed during blasting of the panels to which the coating is being applied. The blasting media by-product may be by-product formed during previous blasting operations on similar panels. Or, in some embodiments, the blasting media by-product may be sourced from blasting operations performed on different types of panel materials.

In some embodiments, no coating is applied to panels. In other embodiments, a primer, a paint, or other coating may be applied to the panels before applying a coating material containing blasting media by-product. For example, in some embodiments, a primer is applied to a panel, followed by a heavy first coat. A second coat and even a third coat may be further applied. The second and/or third coat may be selectively applied to specific areas to cover blemishes, or to change the surface appearance of the specific areas. For example, coats may be added to provide a more consistent surface appearance in some instances, while in other instances, coats may be added to provide a more inconsistent or irregular look. In still further embodiments, only coatings that do not include blasting media by-product are applied to the panels.

Figure 11:
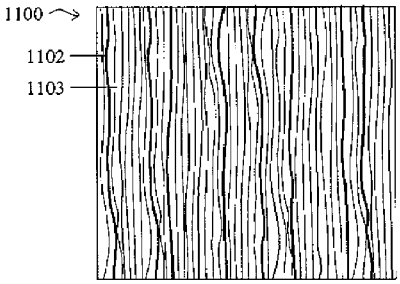
FIG. 11 illustrates one embodiment of a template for use with embodiments disclosed herein.

As mentioned above, in some embodiments, decorative appearances and/or textures other than stucco may be created using methods described herein. For example, in some embodiments, panels may be created which have a wood-grain appearance, such as the appearance of cedar cladding (e.g., cedar shingles or cedar shakes). According to one method, a template 1100 as shown in FIG. 11 may be positioned in front of a panel having a surface including synthetic material. A blasting operation then may be performed to remove certain portions of the panel. Openings 1102 may be configured to allow removal of material to form generally vertical recesses having a weathered summer ring appearance, while lines 1103 of the template are positioned such that portions of the panel are not removed and have a winter ring appearance. Openings 1102 and lines 1103 may have irregular outlines to provide a natural look to the resulting panes. Each opening 1102 may have a varying width along its length, and openings 1102 may be different widths compared to other openings in template 1100 to provide an appearance of various widths of summer and winter rings. The width of the winter and summer growth rings in authentic wood-grain cladding varies according to numerous environmental factors like weather patterns, fluxes in the presence of tree attacking pest and disease, the nutrient condition of the timber stand, and the availability of light to particular trees in the timber stand throughout the life of the lumber-producing tree. In some embodiments, openings 1102 may have an average width of ⅛" or less, and lines 1104 may have an average width of 1/16" or less. Template 1100 or portions thereof may be formed with a hard-faced steel alloy. In particular, lines 1103 may be formed with a durable material which is resistant to blasting operations.

A template to create a wood-grain appearance also may be constructed with columns of wire attached to a frame. The wires may be made of a hardened material so as to be resistant to erosion due to the blasting process. The wires may have different diameters as compared to other wires on the same frame, and/or each wire may have a varying diameter along the length of the wire. The shape of the wire can further influence a ricochet of blasting material which may aid in producing organic-looking irregular rings. This ricochet effect can be adjusted by variations in media size, weight, and shape. In various embodiments, widths of the resulting lines that have the appearance of summer and/or winter rings may be from 1/128" to 6", whether formed by using openings, wires, or other suitable methods.

Figure 12:
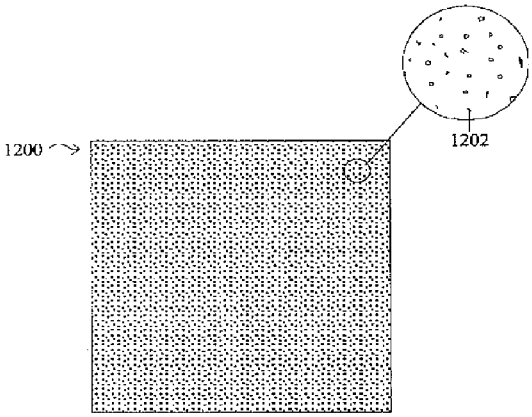
FIGS. 12-14 illustrate one embodiment of a set of templates for use with embodiments disclosed herein.
Figure 14:
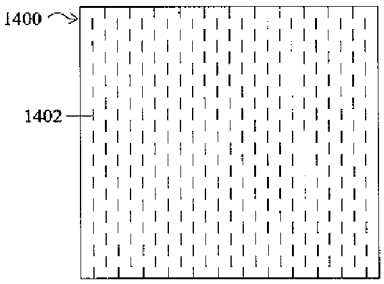
Figure 13:
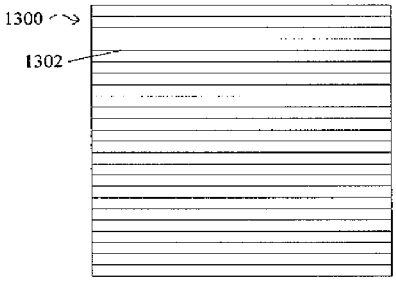

According to other embodiments, cut stone, brick, or other masonry-type designs may be created. For example, to form a brick appearance, three templates may be used, such as templates 1200, 1300 and 1400 shown in FIGS. 12-14. Template 1200 includes small holes 1202 throughout the template and may be used to create a surface having brick surface appearance on a synthetic panel with a first blasting operation. In some embodiments, the panel may be pre-pigmented. In a second blasting operation, template 1300 has horizontal openings 1302 and may be used in conjunction with a blasting operation to create horizontal mortar joint areas on the panel. In a third blasting operation, template 1400 has vertical openings 1402 and may be used in conjunction with a blasting operation to create vertical mortar joint areas on the panel. Any suitable pattern(s) of openings may be used to form various mortar joint patterns. Blasting operations using two or more templates do not necessarily have to proceed in a particular order. For example, in the above brick appearance panel embodiment, templates 1300 and 1400 may be used first (in either order), and template 1200 may be used last. In some embodiments, a single panel may be used to create both the brick surface appearance and one of the vertical or horizontal mortar joint appearances. Cauterization caused by the blasting process may enhance the appearance of the mortar joint areas in some embodiments.

Figure 15:
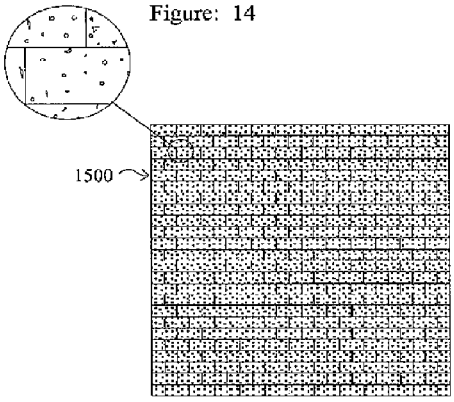
FIG. 15 shows one embodiment of a cladding formed of a panel having a brick-like appearance.

FIG. 15 shows a completed panel 1500 having a brick-like surface appearance which may be formed using templates 1200, 1300 and 1400 in combination with a blasting operation. Numerous smaller panels may be used to create a brick-like cladding. In some embodiments, panel 1500 may be formed of one or more synthetic materials such as PVC, or panel 1500 may be formed of one or more engineered materials.

As with other embodiments described herein, one or more coatings may be added to the panels as part of the process to provide weather protection, pigmentation, or further surface appearance effects.

In still further embodiments, a template may be used which produces a cinder-block appearance. In some embodiments, a blasting process may be used to create the appearance of a split-faced block by forming height differences of 1¼" to 1½" between peaks and valleys.

A panel production apparatus may include a controller which can be instructed to produce panels having specific surface appearances based on user inputs. For example, a user interface may permit a user to select one or more of various parameters such as desired type of surface appearance, depth of material removal, degree of randomness, level of cauterization, number of panels, etc. Based on these inputs, the controller may control the apparatus, such as an apparatus including a blaster, to produce panels, such as panels including a synthetic material.

While several embodiments of the invention have been described and illustrated herein, those of ordinary skill in the art will readily envision a variety of other means and structures for performing the functions and/or obtaining the results or advantages described herein, and each of such variations, modifications and improvements is deemed to be within the scope of the present invention. More generally, those skilled in the art would readily appreciate that all parameters, dimensions, materials, and configurations described herein are meant to be exemplary and that actual parameters, dimensions, materials, and configurations will depend upon specific applications for which the teachings of the present invention are used. Those skilled in the art will recognize, or be able to ascertain using no more than routine experimentation, many equivalents to the specific embodiments of the invention described herein. It is therefore to be understood that the foregoing embodiments are presented by way of example only and that, within the scope of the appended claims and equivalents thereto, the invention may be practiced otherwise than as specifically described. In the claims (as well as in the specification above), all transitional phrases or phrases of inclusion, such as "comprising," "including," "carrying," "having," "containing," "composed of," "made of," "formed of," "involving" and the like shall be interpreted to be open-ended, i.e. to mean "including but not limited to" and, therefore, encompassing the items listed thereafter and equivalents thereof as well as additional items. Only the transitional phrases or phrases of inclusion "consisting of" and "consisting essentially of" are to be interpreted as closed or semi-closed phrases, respectively. The indefinite articles "a" and "an," as used herein in the specification and in the claims, unless clearly indicated to the contrary, should be understood to mean "at least one."

I claim:

1. A method of operating on a panel having a surface which comprises a rigid synthetic material, the method comprising:

removing portions of a rigid synthetic material from a surface of a panel which comprises a rigid synthetic material to create a stucco finish appearance on the panel;

wherein removing portions of the rigid synthetic material comprises removing a portion of the rigid synthetic material to form a recess having a tortuous perimeter;

wherein removing portions of the rigid synthetic material to create a stucco finish appearance comprises positioning a template between the panel surface and a blaster, the template including openings, and operating the blaster to propel blasting material at the panel surface through the openings, wherein the template prevents the blasting material from contacting areas of the panel surface; and applying a coating to the panel after removing portions of the rigid synthetic material, wherein the coating comprises a liquid mixed with aggregate;

wherein the aggregate comprises solid blasting material previously used in a blasting operation.

2. A method as in claim 1, wherein a bottom surface of the recess comprises peaks and valleys, wherein a height difference between a highest peak from among the peaks and a lowest valley from among the valleys is greater than one thirty-second of an inch.

3. A method as in claim 2, wherein the height difference between the highest peak and the lowest valley is greater than one-sixteenth of an inch.

4. A method as in claim 3, wherein the height difference between the highest peak and the lowest valley is less than one half inch.

5. A method as in claim 1, wherein operating the blaster to propel blasting material comprises operating the blaster to propel crushed glass.

6. A method as in claim 1, wherein the panel surface comprises PVC.

7. A method as in claim 1, wherein removing portions of the rigid synthetic material comprises removing a portion of the rigid synthetic material to form a recess having approximately perpendicular sidewalls.

8. A method as in claim 1, wherein operating the blaster to propel blasting material comprises operating the blaster to propel an abrasive blasting material.

9. A method as in claim 8, wherein operating the blaster to propel blasting material comprises pneumatic blasting of the synthetic material.

10. A method as in claim 1, wherein operating the blaster to propel blasting material comprises hydraulic media blasting of the synthetic material.

11. A method as in claim 1, wherein the panel surface comprises cellular PVC.

12. A method as in claim 1, wherein the aggregate comprises crushed glass.

13. A method of manufacturing a plurality of panels for use as cladding for a structure, the method comprising:

for each of a plurality of panels having a surface comprising a synthetic material, positioning at least one of a plurality of templates between the panel surface and a blaster nozzle to leave portions of the panel surface exposed, and propelling a blasting material at the exposed portions of the panel surface to form a stucco appearance on the panel surface; wherein each template of the plurality of templates has a different arrangement of openings as compared to the other templates;

the panel surface comprises cellular PVC;

for each panel, the template used has a different arrangement of openings as compared to the templates used for others of the panels;

applying a coating to the panels after propelling the blasting material at the panel surfaces, wherein the coating comprises a liquid mixed with aggregate; and the aggregate comprises solid blasting material previously used in a blasting operation.

14. A method as in claim 13, wherein the aggregate comprises crushed glass.

* * * * *